US008596255B2

(12) United States Patent
Meggs

(10) Patent No.: US 8,596,255 B2
(45) Date of Patent: Dec. 3, 2013

(54) SUPER ABSORBENT POLYMER PROJECTILE LAUNCHING DEVICE

(75) Inventor: Keith G. Meggs, Rancho Palos Verdes, CA (US)

(73) Assignee: Hobbeezone, Inc., Manhattan Beach, CA (US)

( * ) Notice: Subject to any disclaimer, the term of this patent is extended or adjusted under 35 U.S.C. 154(b) by 78 days.

(21) Appl. No.: 12/973,897

(22) Filed: Dec. 20, 2010

(65) Prior Publication Data

US 2011/0271941 A1 Nov. 10, 2011

Related U.S. Application Data

(63) Continuation-in-part of application No. 12/777,134, filed on May 10, 2010, now Pat. No. 8,371,282.

(51) Int. Cl.
*F41B 11/00* (2006.01)

(52) U.S. Cl.
USPC ..... 124/65; 124/45; 124/56

(58) Field of Classification Search
USPC ..... 124/1, 17, 63, 79, 16, 56, 45
See application file for complete search history.

(56) References Cited

U.S. PATENT DOCUMENTS

| | | | | |
|---|---|---|---|---|
| 71,162 | A | 11/1867 | Hall | |
| 1,202,227 | A * | 10/1916 | Sandifur | 474/81 |
| 3,408,997 | A * | 11/1968 | De Ruymbecke et al. | 124/27 |
| 3,472,218 | A * | 10/1969 | Mers | 124/67 |
| 3,631,555 | A * | 1/1972 | Hurst et al. | 15/3.5 |
| 4,834,059 | A * | 5/1989 | Moorhouse et al. | 124/67 |
| 5,285,765 | A * | 2/1994 | Lee | 124/50 |
| 5,415,151 | A | 5/1995 | Fusi et al. | |
| 5,622,159 | A * | 4/1997 | Liu et al. | 124/66 |
| 5,697,179 | A * | 12/1997 | Vanmoor | 42/87 |
| 6,386,293 | B1 | 5/2002 | Bartlett | |
| 7,004,813 | B2 | 2/2006 | Zuloff | |
| 2004/0104533 | A1* | 6/2004 | Larson et al. | 273/404 |
| 2004/0212151 | A1* | 10/2004 | Peiten et al. | 273/404 |
| 2009/0145412 | A1 | 6/2009 | Barish | |
| 2010/0059237 | A1* | 3/2010 | Cordani | 169/54 |
| 2011/0271940 | A1* | 11/2011 | Meggs et al. | 124/56 |
| 2011/0271941 | A1* | 11/2011 | Meggs | 124/65 |
| 2012/0152221 | A1* | 6/2012 | Meggs | 124/41.1 |

FOREIGN PATENT DOCUMENTS

| | | |
|---|---|---|
| EP | 2 253 375 A1 | 11/2010 |
| GB | 316645 | 8/1929 |

OTHER PUBLICATIONS

International Search Report and Written Opinion for Corresponding PCT Application No. PCT/US2011066307 dated Apr. 24, 2012.
International Search Report and Written Opinion for Corresponding PCT Application No. PCT/US2011/035801 dated Oct. 19, 2011.

* cited by examiner

*Primary Examiner* — Michael David
(74) *Attorney, Agent, or Firm* — Dickstein Shapiro LLP

(57) ABSTRACT

A device for projecting a soft-projectile made from a super absorbent polymer, the device comprising a holder designed for containing the soft-projectile made from a super absorbent polymer; and a firing mechanism operatively arranged to accelerate the holder from a firing position.

20 Claims, 13 Drawing Sheets

SUPER ABSORBENT POLYMER PROJECTILE LAUNCHING DEVICE

CROSS-REFERENCE TO RELATED APPLICATION

This application is a continuation-in-part and claims the benefit of U.S. patent application Ser. No. 12/777,134, filed May 10, 2010 now U.S. Pat. No. 8,371,282, which is hereby incorporated by reference.

FIELD

The present patent document relates to soft-projectile launching devices, such as projectile toys. More particularly, the present patent document relates to soft-projectile launching devices that launch super absorbent polymer projectiles and related devices and methods.

BACKGROUND

Children have a variety of different types of projectile launching toys available to them. For example, HASBRO® makes an entire line of NERF® weaponry that fire NERF® projectiles. NERF® is a trademarked term well known in the toy industry and is associated with soft foam-like material. Other than weaponry, NERF® is also commonly associated with sports balls such as footballs, basketballs, and others. Over the years, a large number of NERF® foam-based weaponry products have been developed, including various blasters that launch various types of NERF® projectiles including darts, rockets, and balls.

NERF® foam is a spongy cellular material produced by the reaction of polyester with a diisocyanate. The polyester resin reacts with the diisocyanate while $CO_2$ is simultaneously released by another reaction. The $CO_2$ gas creates open pockets within the polyurethane that give the NERF® foam its soft and light properties.

One reason the NERF® foam and other foam based projectile toys have became so popular has been due to the soft and light properties of the foam material. For example, NERF® balls were originally marketed as the "world's first official indoor ball." These same soft and light properties also make NERF® and other foams a great material for projectiles. Projectiles made from NERF® and other similar foams can be formed into balls and darts and fired from toy weaponry with little risk of injury. To this end, HASBRO® and other toy manufacturers have created numerous toy weaponry lines that shoot foam based projectiles including the N-Strike® line of toys.

Although NERF® and other foam like materials can be used to make toy weaponry projectiles that are relatively safe to project or launch, the properties of NERF® and other foam like materials have some significant drawbacks when used as projectiles for projectile launching toys. Because foam based materials such as NERF® foam are light, they are highly susceptible to air forces when trying to project them through the air in free flight as occurs when fired from toy weaponry. The soft, light properties of foam and NERF® type products are due to their low density. The low density of foam based projectiles decreases the momentum of the projectiles, which in turn increases the effect of air resistance, drag, and other motion retarding forces. This causes foam based projectiles to rapidly slow after initial firing and easily curve off line.

There are also small projectile systems for gaming and professional training purposes. These include paint ball guns and airsoft guns, but these systems are for adult use only due to the energy imparted to the projectile and the ability of the projectile to do serious harm.

SUMMARY OF THE INVENTION

One object of the present patent document is to provide an alternative soft-projectile launching system to those presently on the market. To this end, in one embodiment, a projectile launching device is provided that launches projectiles made from super absorbent polymers. The projectile launching device comprises: a holder designed for containing the soft-projectile made from a super absorbent polymer; and a firing mechanism operatively arranged to accelerate the holder from a firing position.

In another embodiment the holder of the soft-projectile launching system is slideably contained by the device. In another embodiment, the holder for a soft-projectile translates between the firing position and a launch point for the soft-projectile. In yet another embodiment the soft-projectile launching system further comprises a barrel having an interior in communication with the firing position wherein the holder for a soft-projectile translates down the barrel such that a soft-projectile launches from the barrel with little or no contact with the interior of the barrel.

In one embodiment, the soft-projectile launching system may have a firing mechanism incapable of storing energy independent of the user. Yet in other embodiments, the launching system may store energy. The soft-projectile launching systems of the present patent document may use air pressure, springs, rubber bands or any other suitable firing mechanism to launch the soft-projectile.

In another aspect of the present patent document, ammunition for a soft-projectile projection device is provided. The ammunition according to one embodiment comprises a plurality of projectiles made from a super absorbent polymer. The projectiles may be contained in a magazine. The projectiles may be hydrated or dehydrated.

In one embodiment, the projectiles have a diameter of less than 10 millimeters when hydrated. In yet another embodiment, the projectiles have a diameter of more than about 4 mm and less than about 9 mm when hydrated.

In another aspect of the present patent document, a magazine for a device for projecting soft-projectiles is provided. The magazine according to one embodiment comprises: a container having an interior volume having at least one opening wherein the container is configured to operatively mate with a device for projecting soft-projectiles and a plurality of projectiles made from a super absorbent polymer contained within the interior volume. The projectiles in the magazine may be hydrated or dehydrated and the magazine may include an inlet opening configured to only allow dehydrated projectiles to pass through into the magazine.

In one embodiment, the magazine further comprises a locking mechanism that prevents an outlet opening from opening unless the magazine is mated with a corresponding projection device.

In yet another aspect, a method of producing soft-projectiles is provided. The method comprises the steps of: placing a plurality of pieces of a super absorbent polymer in a liquid; allowing time for the plurality of pieces of a super absorbent polymer to absorb the liquid; and placing the plurality of pieces of a super absorbent polymer in a magazine.

In yet another aspect, a kit for making a plurality of soft-projectiles from a super absorbent polymer is provided. In one embodiment, the kit comprises: a predetermined quantity of dehydrated projectiles stored in a container, the dehydrated projectiles comprising a super absorbent polymer; instructions for adding the dehydrated projectiles into an interior chamber of a magazine and hydrating the dehydrated projectiles in the interior chamber of the magazine. The container may, for example, comprise a sealed pouch or other low cost, disposable container.

In another embodiment, an adaptation mechanism for a projectile toy comprises: a soft-projectile holder adapted to hold a soft-projectile made from a super absorbent polymer; and an attachment mechanism connected to the soft-projectile holder wherein the attachment mechanism is designed to mate to a firing mechanism of the projectile toy.

In addition to the embodiments described above, a method of play is provided. In one embodiment, the method of play comprises launching a super absorbent polymer projectile from a projectile launcher. The launcher may come in any form including a toy weapon or a gun.

In some embodiments described herein including embodiments of the method of play, the soft-projectile made from a super absorbent polymer may be adapted for use with the firing mechanism of the projection device. In some embodiments, for example, the super absorbent polymer may have a relatively high cross-link density. The durability of the super absorbent polymer may, for example, be increased to prevent substantial damage to the soft-projectile during the launching step. In other embodiments the cross-link density of the super absorbent polymer may be set so that it is sufficient to keep the soft-projectile from breaking apart during the launching step.

Various embodiments and methods may also use various types of firing mechanisms, including firing mechanisms that use direct impact or indirect impact. For example, in some embodiments the projectile launcher comprises a firing mechanism that directly applies a force to the super absorbent polymer and in other embodiments the firing mechanism indirectly applies force to the super absorbent polymer. Further, in certain embodiments and methods, the firing mechanism stores energy independent of the user. In other embodiments, the firing mechanism is incapable of storing energy independent of the user.

In one embodiment of the method of play, the projectile launcher does not include a holder for the super absorbent polymer projectile to help transfer energy of a firing mechanism of the projectile launcher into motion of the super absorbent polymer projectile.

In yet another embodiment, the method of play further comprises loading the super absorbent polymer projectile into the projectile launcher from a magazine.

In another embodiment, a launching system is provided; the launching system comprises a projectile launcher for launching ammunition made from a super absorbent polymer and ammunition made from a super absorbent polymer that is adapted to be launched from the projectile launcher. In various embodiments of the projectile launching system, the projectile launcher is embodied by the various embodiments of a projection device described herein. Similarly, in various embodiments of the projectile launching system, the ammunition made from a super absorbent is embodied by the various embodiments of soft-projectiles described herein.

The super absorbent polymer projectile launching toys and/or weaponry described herein may increase the user experience as compared to foam-based projectile toys, yet they remain safe for children to use. Further aspects, objects, desirable features, and advantages of the devices and methods disclosed herein will be better understood from the detailed description and drawings that follow in which various embodiments are illustrated by way of example. It is to be expressly understood, however, that the drawings are for the purpose of illustration only and are not intended as a definition of the limits of the claimed invention.

DETAILED DESCRIPTION OF THE PREFERRED EMBODIMENTS

Figure 1:
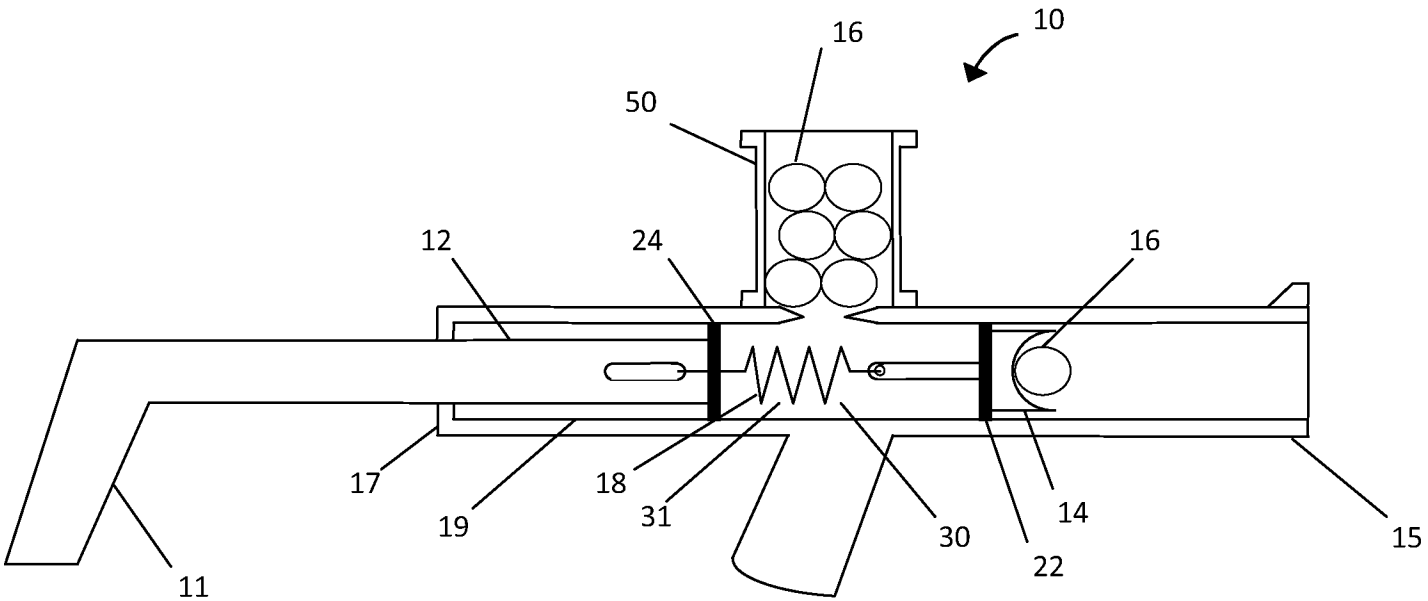
FIG. 1 illustrates a cross section of one embodiment of a projectile launching toy designed for use with a plurality of projectiles made from a super absorbent polymer.

The term "magazine" is used herein to refer to any container that holds super absorbent polymer projectiles for a projectile toy gun or other projectile weaponry. The magazine could be of any shape size or volume and have any number of openings as long as it holds super absorbent polymer projectiles in a useable manner for a corresponding super absorbent polymer projectile launching device.

Super absorbent polymers (SAP's) were first invented by the United States Department of Agriculture (USDA) in the 1960's and are commonly used in personal disposable hygiene products such as diapers, protective underwear, and sanitary napkins. SAP's are polymers that can absorb an extremely large amount of liquid relative to their own mass. SAP's absorb aqueous solutions through hydrogen bonding with water molecules.

The present patent document discloses and teaches projectile launching devices, such as toys, amateur guns and weaponry that use projectiles formed from a super absorbent polymer (SAP). As a result, the projectiles launched by the devices of the present patent document are soft-projectiles. Further, once hydrated, the unique properties that SAP's exhibit give the soft-projectiles several advantages over current projectile materials such as paint balls, plastics, and foams. For example, hydrated SAP projectiles can maintain their shape under modest pressure. The ability of SAP projectiles to maintain their shape allows them to be projected with a reasonable force and velocity without breaking apart. However, under excessive pressure, hydrated SAP projectiles will break down and lose their shape. Because SAP projectiles break down under excessive pressure, the force at impact is spread over a much wider surface area, thus reducing the likelihood of injury.

SAP projectiles can also be designed to break down at different pressures based on their composition. This allows them to be tailored to have specific qualities as soft-projectiles. The total absorbency and swelling capacity of a SAP varies depending on the degree of cross-linking within the polymer. The lower the density of the cross-linking the higher the absorbent capacity of the SAP. Thus, low density cross-linked SAP's generally have a higher absorbent capacity and swell to a larger degree than more highly cross-linked SAP's. Low density cross-linked SAP's also have a softer and more cohesive gel formation. High cross-link density polymers exhibit lower absorbent capacity and swell. The gel strength is firmer and can maintain particle shape even under higher pressures.

Consequently, by using a SAP with a higher cross-link density, a soft-projectile can be made to fly farther and faster without breaking apart and have a stronger impact. In contrast, soft-projectiles made from a SAP with a lower cross-link density will break apart more easily and have a much softer impact. Depending on the level of safety required, different SAP's with different cross-link densities may be used. For example, SAP's can be constructed that would be considered "highly compliant" by industry standards.

Soft-projectiles made from a SAP are preferably round but may be of other shapes as well, including, for example, dart shapes, cylinder shapes, bullet shapes, oval, square, rectangular or any other shape. Round is a preferable shape not only because it has fairly good ballistic characteristics but because SAP's are easily formed in round shapes.

Soft-projectiles made from a SAP can be any size. Preferably, however, the soft-projectiles made from a SAP are between about 3 millimeters (mm) and about 15 mm in diameter when hydrated and more preferably between about 5 mm and 8 mm in diameter when hydrated. Typically, the soft-projectiles are about 1 mm or less when the SAP forming the projectile is dehydrated.

Larger soft-projectiles made from a SAP are possible. For example, rounds having a diameter of 30 mm have been created. However, there is approximately a 20% tolerance on the final diameter of the hydrated SAP soft-projectiles and therefore, the larger rounds are more difficult to make consistently uniform in diameter.

The SAP projectiles may be colorless to prevent any staining upon impact. Alternatively, soft-projectiles made from a SAP may also have additives added during the formulation of the SAP or during hydration that will create a temporary or indelible signature upon hitting a target. For example, soft-projectiles made from a SAP may be colored by adding a die to the SAP or the aqueous solution during the hydrating process. Depending on the die employed, the resulting signature may be of any desired color. Further, the employed die compound may be visible under normal lighting conditions or only under an ultra violet black light. Other additives may also be used including those that give the soft-projectiles a tracer effect such as glow-in-the-dark additives or other materials with luminescent properties.

Soft-projectiles made from water absorbing polymers, classified as hydrogels, will absorb aqueous solutions through hydrogen bonding with the water molecule. A SAP's ability to absorb water is a factor of the ionic concentration of an aqueous solution. Consequently, soft-projectiles made from a SAP are preferably grown in water with a PH of 7. More preferably soft-projectiles made from a SAP are grown in distilled water, where they may absorb 500 times their weight, and from 30-60 times their dehydrated volume.

FIG. 1 illustrates a cross section of one embodiment of a projection device 10, which in the present embodiment is a projectile launching toy, designed for use with soft-projectile 16. The soft-projectiles of the present patent document are formed from a super absorbent polymer. As shown in FIG. 1, projection device 10 is in the general form of a gun. However, in other embodiments, projection device 10 can have shapes and designs of other devices. For example, projection device 10 can be a bow, crossbow, sling shot, hand gun, machine gun, futuristic weapon, catapult, or shaped as any other type of weaponry. Projection device 10 can be made of a number of suitable materials including metals, rubbers and plastics; however, injection molded plastic is a preferred construction material.

Projection device 10 has firing mechanism with a firing position 30. The firing position 30 is where the soft-projectile 16 is positioned just prior to being fired or launched from the projection device 10. The firing mechanism of the embodiment shown in FIG. 1 is based on air pressure, which is created in air compression chamber 31. However, the firing mechanism of the projection device 10 may be based on any of the known ways of firing or launching projectiles or ammunition from a projection device. For example, springs or rubber bands can be stretched and released to launch the projectile from the projection device 10. These springs or rubber bands may further use a mechanical advantage to increase the velocity of the projectile as it is launched. As an example, compound bows use a system of levers or pulleys to make the transfer of energy from the spring of the bow to the projectile more efficient. In addition to springs and rubber bands, air pressure can be used, as in the embodiment illustrated in FIG. 1. Air pressure can be created in a number of ways including, for example, from a plunger operated by the user, from a cartridge containing compressed gas (such as the $CO_2$ cartridges used with paint ball guns), from air that has been pumped into an internal chamber and then released, or from an explosion in a chamber.

In addition, various techniques of launching a projectile may also be combined. For example, the embodiment shown in FIG. 1 uses the combination of a spring and air pressure. The components of FIG. 1 will now be further described with respect to the use of projection device 10 to launch a soft-projectile 16 made from a SAP.

To begin the process of firing a soft-projectile 16 made from a SAP with the device shown in FIG. 1, a user pulls back on the handle 11 which retracts the plunger 12 out of the aft end 17 of a plunger cylinder 19. The plunger 12 is attached to spring 18. As the spring 18 is stretched, air is sucked into an air compression chamber 31 located between plunger seal 24 and air seal 22. Air seal 22 abuts against a stop (not shown) just behind the firing position 30 to prevent air seal 22 from following the plunger 12 past a certain point as it is drawn back. Consequently, the spring 18 is stretched. When the user releases the handle 12, the spring 18 quickly pulls the plunger 12 back inside the plunger cylinder 19. This creates a rapid increase in air pressure in the air compression chamber 31 between plunger seal 24 and air seal 22. Consequently, air seal 22 is propelled rapidly through barrel 15 towards the distal end of barrel 15 and simultaneously accelerates the holder 14 for a soft-projectile and the soft-projectile 16. The soft-projectile 16 is launched from the projection device 10 on a free trajectory and the air seal 22 and soft-projectile holder 14 are retained within the barrel 15 of projection device 10.

In the embodiment of the projection device 10 shown in FIG. 1, the air seal 22 and the soft-projectile holder 14 are retained via their connection to the spring 18. However, the soft-projectile holder 14 and air seal 22 may be retained by other means. For example, a stop (not shown) may be installed inside of barrel 15 to prevent air seal 22 or soft-projectile holder 14 from escaping but allow the soft-projectile 16 to pass freely. Preferably, the stop is located adjacent the barrel exit to maximize the distance over which the soft-projectile 16 is carried in the holder 14 before exiting the barrel.

Once the soft-projectile 16 made from a SAP has been launched, the plunger 12 and plunger seal 24 have been pulled inside the plunger cylinder 19 to the extent possible. In this position, the plunger seal 24 is located just behind the firing position 30. When the user wants to fire another round, the user pulls back on the handle 11. As the plunger 12 is retracted, air seal 22 and soft-projectile holder 14 are drawn behind the magazine or feed hopper 50. Once the air seal 22 and the soft-projectile holder 14 are positioned behind the magazine or feed hopper 50, another soft-projectile made from a SAP 16 can fall into the firing position 30.

Toy guns and weaponry are typically classified into two different categories: 1) devices that can transfer stored energy into the projectile; and 2) devices that are incapable of storing energy independent of the user. The projection device 10 embodied in FIG. 1 is of the latter type. However, the device in FIG. 1 could be easily modified to store energy. For example, a one way valve could be added in combination with a trigger mechanism to prevent air seal 22 and soft-projectile holder 14 from advancing. The plunger 12 could be used to pump additional pressure into the air compression chamber 31 behind air seal 22. The user would then pull the trigger to release the pressure that has built up from multiple pumps of the plunger 12.

Figure 2:
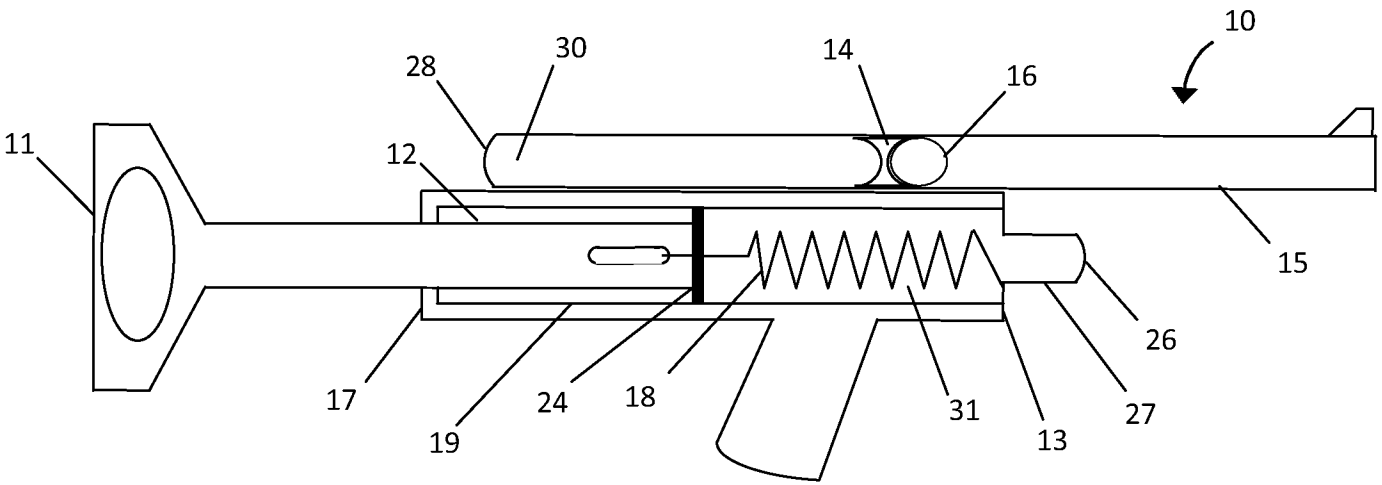
FIG. 2 illustrates a cross section of one embodiment of a projectile launching toy designed for use with a projectile made from a super absorbent polymer.

FIG. 2 illustrates a cross section of another embodiment of a projection device 10 designed for use with soft-projectiles 16 made from a super absorbent polymer. Projection device 10 of the present embodiment is a projectile launching toy. In the device 10 shown in FIG. 2, the smaller diameter tube 27 is wrapped back around to the back of the projection device 10 and laid on top of the projection device 10 so that tube portions 26 and 28 are continuously connected. In the embodiment in FIG. 2, the volume in front of plunger seal 24 transitions from plunger cylinder 19, which has a comparatively large diameter, to a tube 27, which has a smaller diameter than plunger cylinder 19. The change in the diameter of the air compression chamber 31 from the plunger cylinder 19, which comprises a tube of a relatively larger diameter, to a smaller diameter tube 27 will cause, during use of the device, a rapid increase in the velocity of the air flow in correlation with the conservation of energy and Bernoulli's principle. Consequently, the rapid air flow is forced down the length of the smaller diameter tube 27 until it escapes out the front of the projection device 10. As the air rushes down the smaller diameter tube 27 the soft-projectile holder 14, which fits with an air seal inside the smaller diameter tube 27, is rapidly accelerated with the air, carrying the soft-projectile 16 made from a SAP and launching it out of the projection device 10.

Although the embodiments illustrated in the present patent document include a smaller diameter tube 27, other embodiments may include a tube of any diameter including a tube of larger diameter. As explained above, it is preferable to use a tube with a smaller diameter than the diameter of the air compression chamber 31 to take advantage of the Bernoulli principle. However, using a tube with a smaller diameter is not a requirement. In addition, the barrel 15 may be considered part of the smaller diameter tube 27 or as a separate component connected to the smaller diameter tube 27.

Unlike the embodiment of FIG. 1, the soft-projectile holder 14 is not retained by the spring. In the embodiment of FIG. 2, the soft-projectile holder 14 is slideably contained by the barrel 15, but is not otherwise attached. The soft-projectile holder 14 acts as a free sliding piston that may operate independently of the plunger 12. A stop near the end of the barrel 15 and a stop near tube position 30 retains the soft-projectile holder 14 within a desired operating region of the barrel 15. The stop near the end of the barrel 15 should be designed to retain the soft-projectile holder 14 without interfering with the launching of the soft-projectile 16 made from a SAP.

FIG. 2 illustrates a device 10 having a smaller tube 27 that wraps from a position relatively near the distal or front end 13 of plunger cylinder 19 back to a position relatively near the proximal or back end 17 of plunger cylinder 19 and then extends down the length of the plunger cylinder 19. This is not required and the smaller tube could simply extend straight away from distal end 13. However, by wrapping the tube as shown in FIG. 2, the more rigid structure of the plunger cylinder can be used to help stiffen the tube 27.

The soft-projectile holder 14 is preferably designed to minimize, or even prevent altogether, the contact of the soft-projectile 16 with the barrel 15 as the soft-projectile 16 travels down the barrel 15. Although soft-projectile holder 14 is not a requirement, minimizing the contact between the soft-projectile 16 and the barrel 15 is preferable. The soft-projectile 16 will tend to retain its shape, especially if the cross-link density is high. However, if the soft-projectile 16 is nicked, scratched, or damaged by the barrel as it accelerates, it may disintegrate prior to exiting the barrel 15, especially if the cross-link density is low. If the soft-projectile 16 disintegrates prior to exiting the barrel 15, the soft-projectile 16 will not fly accurately or the correct distance. Consequently, the design of the soft-projectile holder 14 should take care to encase enough of the soft-projectile 16 to prevent it from touching the sides of the barrel 15 as it travels. The soft-projectile holder 14 is preferably cup shaped in a form that mates with the exterior surface of the soft-projectiles 16 to be employed with the device. However, the soft-projectile holder 14 may be bucket shaped, crescent shape, or any other shape that helps prevent or suitably minimize the contact between the soft-projectile 16 and the barrel 15.

In addition to preventing contact between the soft-projectile 16 and the barrel 15 during launch, the soft-projectile holder 14 also helps transfer the energy of the firing mechanism into the motion of the soft-projectile 16. In addition, if shaped similar to soft-projectile 16, the soft-projectile holder 14 helps distribute the force generated by the firing mechanism evenly over the soft-projectile 16 and therefore, helps prevent the soft-projectile 16 from breaking during launch. Consequently, a holder 14 that mates more appropriately with the shape of the outside surface of the soft-projectile 16 is preferable. Furthermore, the soft-projectile holder 14 may help center the soft-projectile 16 and keep the soft-projectile 16 centered as it travels down the barrel 15. To this end, a soft-projectile holder 14 in the shape of a hemisphere may be used with round soft-projectiles 16. The hemispherically shaped holder 14 may have a diameter slightly larger than the soft-projectile 16 to not only help prevent contact with the interior of the barrel 15, but also to accommodate variations in the diameters of soft-projectiles 16.

Although the embodiments of FIGS. 1 and 2 illustrate a device 10 using a spring and air pressure, and preferably a combination of a spring and air pressure is used, projection device 10 can use a catapult system, sling shot, bow style or any other type of acceleration system to launch the soft-projectile 16. As another example, projection device 10 can accelerate the soft-projectile or soft-projectile holder by an accelerating mass, like the hammer of a gun, impacting the soft-projectile or soft-projectile holder. Furthermore, these devices can all be set up to work with stored energy or work with only energy provided by a user without departing from the embodiments of the present patent document.

Figure 3:
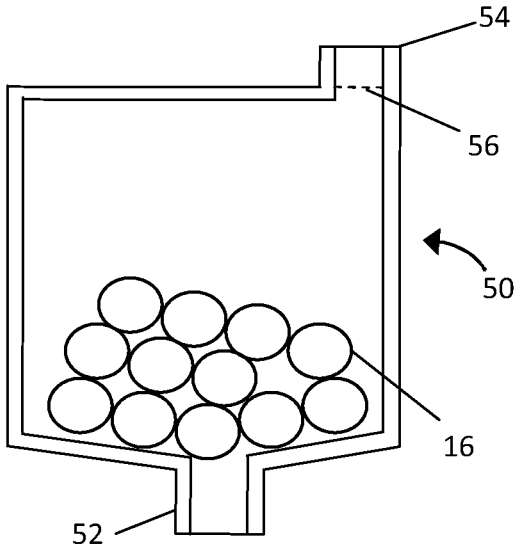
FIG. 3 illustrates a cross section of a projectile magazine for use with a projectile launching toy such as that shown in FIG. 1.

FIG. 3 illustrates a cross section of a magazine 50 for use with a projectile device 10, such as the projectile launching toy shown in FIG. 1. Magazine 50 can be of any shape or size and is intended to contain the soft-projectiles 16 made from a SAP. Magazine 50 can be made of metal, glass, plastic, rubber, or any other suitable material. Preferably magazine 50 is constructed of injected molded plastic. Magazine 50 may be reusable and refillable or designed for a single use and disposable. Magazine 50 can be loaded with already hydrated soft-projectiles 16 made from a SAP. Alternatively, magazine 50 can be loaded with dehydrated soft-projectiles 16 made from a SAP. If dehydrated soft-projectiles are used, water or another aqueous solution is added to the magazine 50 to hydrate the soft-projectiles 16 made from a SAP. Magazine 50 is preferably sealable to prevent water or moisture from the soft-projectiles 16 from leaking out.

Magazine 50 has a first opening 52 designed to mate with a projection device 10. Preferably the first opening 52 of magazine 50 includes a locking mechanism, such as a trap door, that blocks the first opening when the magazine 50 is not mated to a corresponding projection device 10. The locking mechanism provides a safety mechanism that prevents foreign objects from being loaded into the magazine 50 and launched by the projection device 10. The locking mechanism can be a keying system, child safety device, or other locking mechanism that prevents foreign objects from being loaded into the magazine.

The opening on the projection device 10 that mates with the magazine preferably has a corresponding locking mechanism to complement the locking mechanism on the magazine 50. Consequently, soft-projectiles 16 may only be loaded into the projection device 10 from the magazine 50. Similar to the locking mechanism that prevents foreign objects being loaded into the magazine 50, the corresponding locking mechanism on the opening in the projection device prevents foreign objects from being loaded directly into the projection device 10 and then launched.

As shown in FIG. 3, the magazine 50 may have a second opening 54 for refilling the magazine with soft-projectiles 16 made from a SAP into the magazine. The second opening 54 may be large enough to allow hydrated soft-projectiles 16 to be loaded directly into the magazine. In such a case, the interface between the magazine 50 and the projection device 10 should be designed to prevent foreign objects from being loaded from the magazine 50 into the projection device 10 and subsequently launched.

Alternatively, the second opening 54 may further include a screen 56 designed to prevent passage of objects larger than a particular size. The dehydrated SAP pieces forming the soft-projectiles 16 may typically have a diameter of about 1 millimeter (mm) or less. In such embodiments, the screen 56 can be designed to only allow objects of approximately 1 mm or less in diameter to pass through. The dehydrated soft-projectiles 16 can then be loaded into the magazine 50 and water or another aqueous solution can be added and the soft-projectiles 16 can swell to their appropriate size. The screen 56 is a safety mechanism to make sure foreign objects are not loaded into the magazine 50 and then subsequently launched from the projection device 10. Although it is recognized that foreign objects of less than 1 mm can be loaded into the magazine, objects of less than 1 mm are much less likely to cause significant damage if subsequently launched by the projection device 10 because of their reduced size and weight.

The dehydrated soft-projectiles 16 may be sold in a kit designed to refill a magazine 50. In one embodiment, the kit comprises a pre-counted number of dehydrated rounds designed to fill up a particular magazine when hydrated. A magazine 50 preferably holds between 150 and 250 rounds and more preferably holds about 200 soft-projectiles 16. However, the magazine 50 and the kit that fills the magazine 50, can hold any number of soft-projectiles. For example, larger clips of approximately 500 to 1000 rounds may be used for machine guns, Gatling guns, or other rapid fire projection devices 10. In contrast, magazines or clips of 6 to 20 rounds may be used for single shot toys and weaponry.

The kit preferably further includes instructions on how to insert the dehydrated rounds into the magazine 50 and grow the dehydrated rounds inside the magazine 50. After purchasing a kit, a user would dump the dehydrated rounds into the magazine and follow the directions to add distilled water or another appropriate aqueous solution to hydrate the rounds and swell them into their appropriate size for launching from a projectile device 10.

In addition to projection devices designed specifically to launch soft-projectiles 16, embodiments of the present patent document include adaption devices to adapt existing projectile toys and weaponry to launch soft-projectiles 16. Adaption devices attach to the firing mechanism of the existing toy or weaponry and allow the transfer of energy from the firing mechanism into kinetic motion of the SAP projectile 16 without damaging the SAP projectile 16. Preferably, soft-projectile holders 14, similar to those of FIGS. 1 and 2, are retrofit to the existing toys and/or weaponry to protect the soft-projectile made from a SAP 16. However, such holders are not required, and other methods may be used without departing from the scope of the embodiments of the present patent document.

Figure 4:
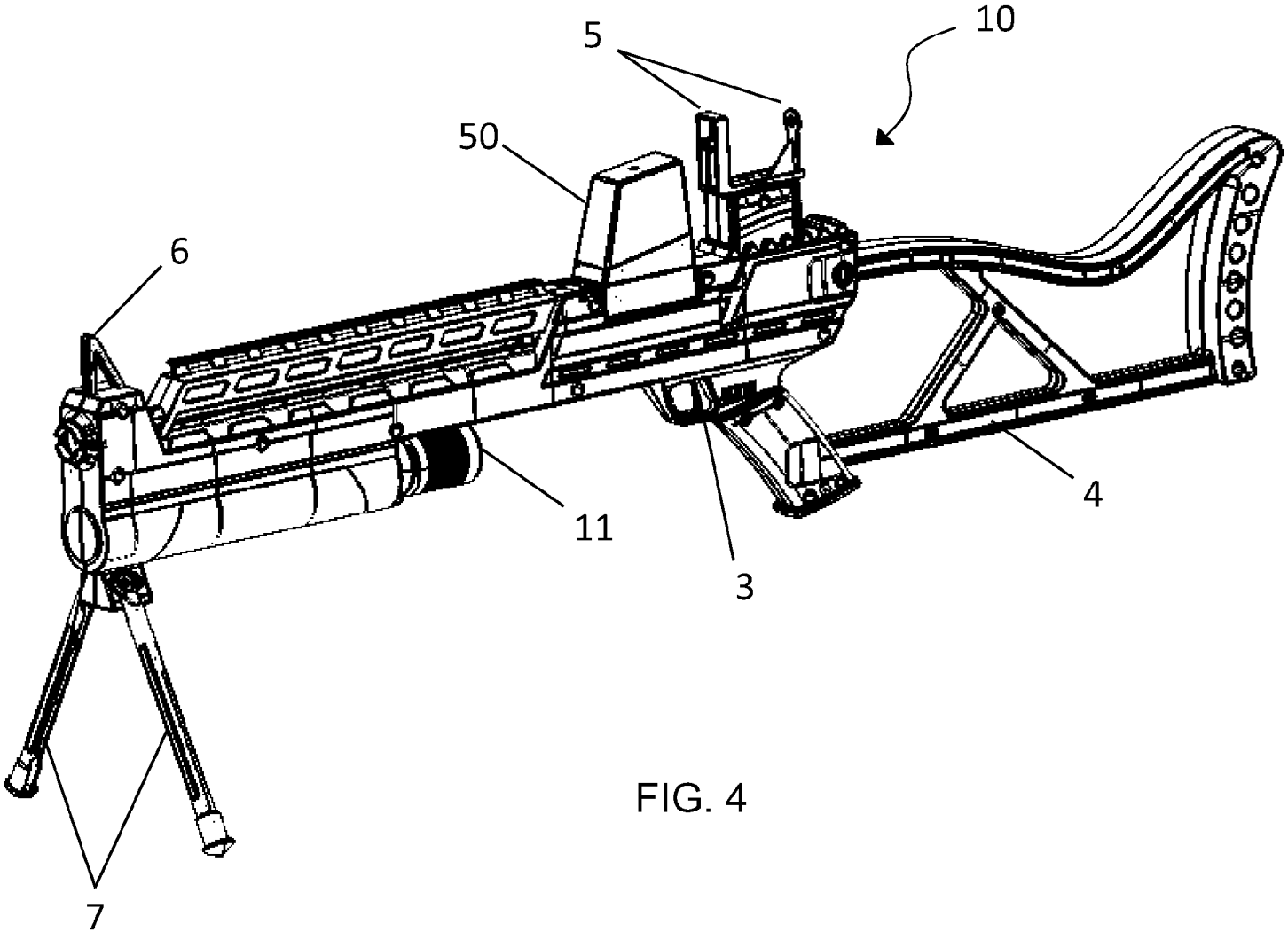
FIG. 4 illustrates a perspective view of one embodiment of a projection device designed to be used with soft projectiles.

FIG. 4 illustrates a prospective view of another embodiment of a projection device 10 designed to be used with soft projectiles, such as ammunition made from a super absorbent polymer. The projection device 10 of FIG. 4 is a projectile launching toy shaped in the form of a gun. The gun shaped projection device embodied in FIG. 4 includes a magazine 50 to hold ammunition made from a super absorbent polymer 16. The projection device 10 of FIG. 4 further includes a handle 11 which allows the user to activate the firing mechanism of the projection device 10. As may be seen in FIG. 4, the handle 11 in the illustrated embodiment is positioned under barrel 15 in a shotgun style pump position on the toy gun. Generally, however, the handle 11 may be operably located in any position on the projection device 10 that allows a user to easily pull and release or pull and pump the handle 11.

In embodiments of the projection device 10 that store and release energy, a finger trigger 3 is preferably included. Finger trigger 3 may be mechanically connected to the firing mechanism to release the stored energy when finger trigger 3 is depressed by a user. In embodiments that also include handle 11, the user may pull the handle 11 back and lock it in the pulled back position. The finger trigger 3 may then be depressed to release the handle 11 and activate the firing mechanism.

In addition, the projection device 10 may have a number of attachments or enhancements that increase the user's experience when playing with the projection device 10. For example, in the case of a gun as shown in FIG. 4, the gun may further include a stock extender 4, a gun sight 5, alignment sight 6, a retractable stand 7 and any other attachments or components that would further enhance the user's experience, including improving the functionality, realism or life-like nature of the projection device 10.

Figure 5:
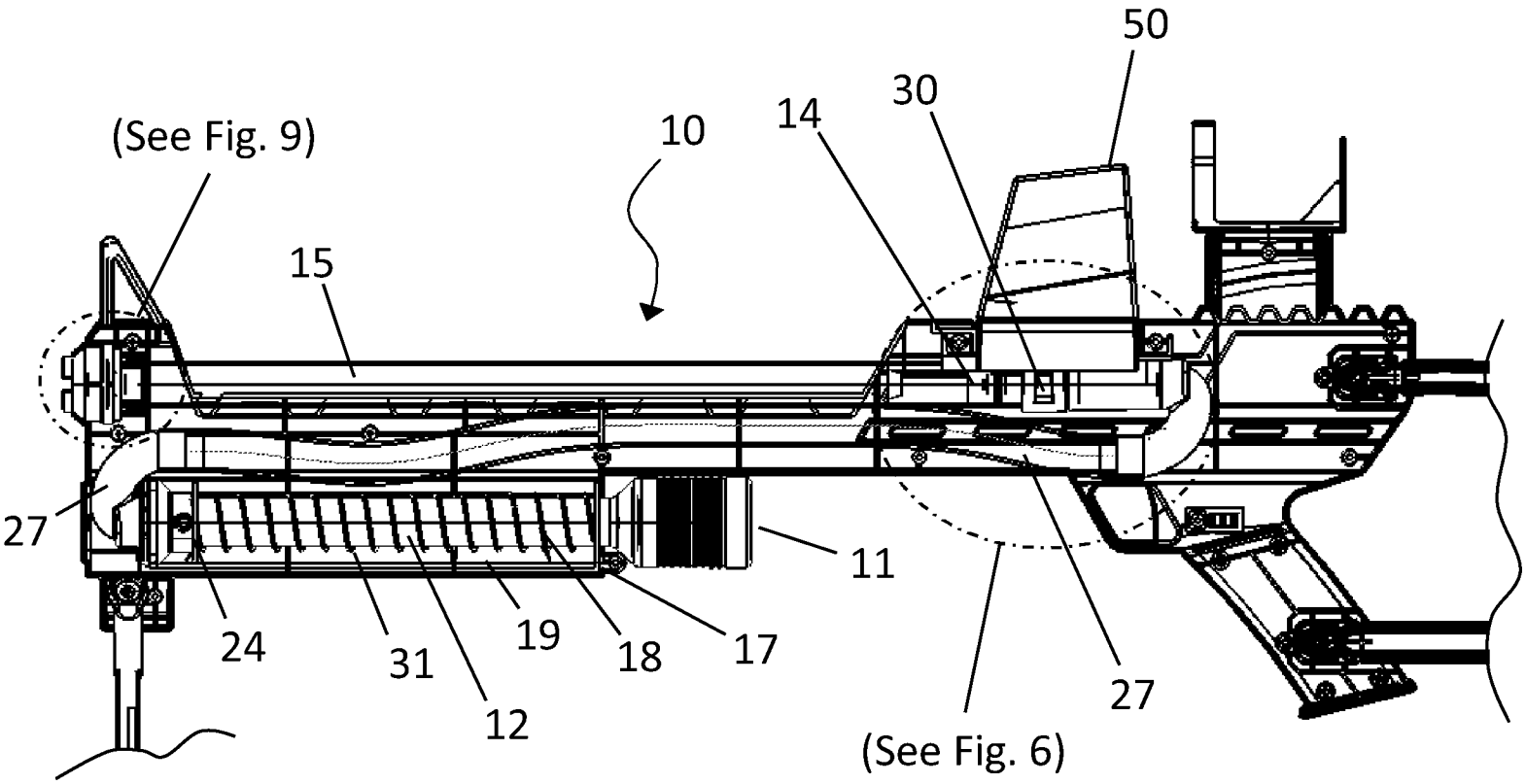
FIG. 5 illustrates a side view of the projection device shown in FIG. 4 with its casing removed so as to expose the inner components.

FIG. 5 illustrates a side view of the embodiment of FIG. 4 with the casing removed so as to expose the inner components of the projection device 10. The firing mechanism of the embodiment shown in FIG. 5 is similar to the firing mechanism of the embodiment of FIG. 2. Both embodiments include a firing mechanism based on air pressure. The air pressure of FIG. 2 and FIG. 5 is created in air compression chamber 31. A smaller diameter tube 27 traverses through the gun and then extends substantially straight down the length of the gun to form the barrel 15 and direct the compressed air.

In the embodiment shown in FIG. 5, the spring 18 is designed to wrap around the plunger 12, so that spring 18 is compressed, rather than stretched as it is in the embodiment of FIG. 2, when handle 11 is pulled by the user into the firing position. Further, by extending the plunger 12 through the center of the spring 18, the air compression chamber 31 may include the entire volume of the plunger cylinder 19.

In operation, a user pulls the handle 11 which draws the plunger 12 and plunger seal 24 towards the aft end 17 of the plunger cylinder 19. As the plunger 12 is retracted through the plunger cylinder 19, the spring 18 is compressed against the aft end 17 and air is sucked into the expanding air compression chamber 31. When the spring 18 is fully compressed against the aft end 17, the plunger 12 is fully retracted and the air compression chamber 31 substantially includes the entire volume of the plunger cylinder 19.

When the user releases the handle 11, the spring 18 rapidly expands and forces the plunger seal 24 back down the plunger cylinder 19 rapidly reducing the size of the air compression chamber 31. Similar to the embodiment of FIG. 2, the rapid air flow is forced down the length of the smaller diameter tube 27 and barrel 15 until it escapes out the front of the projection device 10. As the air rushes down the smaller diameter tube 27, the soft-projectile holder 14, which fits with an air seal inside the barrel 15, is rapidly accelerated with the air down the barrel, carrying the soft-projectile 16 made from a SAP and launching it out of the projection device 10.

In a preferred embodiment, the volume enclosed by the smaller diameter tube 27 and the air compression chamber 31 between the seal of soft-projectile holder 14 and the plunger seal 24 is substantially sealed. In a preferred embodiment, the plunger cylinder 19 further includes a one-way valve that allows the plunger cylinder 19 to suck air into the air compression chamber 31, but prevents air from escaping when the handle 11 is released and the plunger 12 is rapidly forced back into the compression chamber 31 by the expanding spring 18.

Substantially sealing the volume between the soft-projectile holder 14 and the plunger seal 24 allows the position of the soft-projectile holder within the smaller diameter tube 27 to be manipulated by the user when pulling or releasing the handle 11. In addition to causing the soft-projectile holder 14 to rapidly accelerate down the smaller diameter tube 27 when the user releases the handle 11, the seal may also be used to pull the soft-projectile holder 14 into the firing position 30. As the user pulls the handle 11 back and expands the volume of the air compression chamber 31, air is sucked from the smaller diameter tube 27. As the air is pulled from the smaller diameter tube 27, the soft-projectile holder 14 is drawn back down the barrel 15 towards the firing position 30.

Once the soft projectile holder 14 is in the firing position 30, additional air may be sucked into the air compression chamber through a one way valve. However, a one way valve is not necessary and air may be sucked in through small imperfections in the seal between the plunger seal 24 and the seal around the soft-projectile holder 14.

As may be seen by the embodiment shown in FIG. 5, the smaller diameter tube 27 may be comprised of numerous tube components. Forming the smaller diameter tube 27 out of more than one piece may allow for a cheaper and more cost effective construction. Furthermore, because a portion of the smaller diameter tube 27 is required to be straight to form the barrel 15 and other portions of the small diameter tube 27 may traverse a tortuous path to conform to the inside of the gun, using different types of tube may be advantageous.

Figure 6:
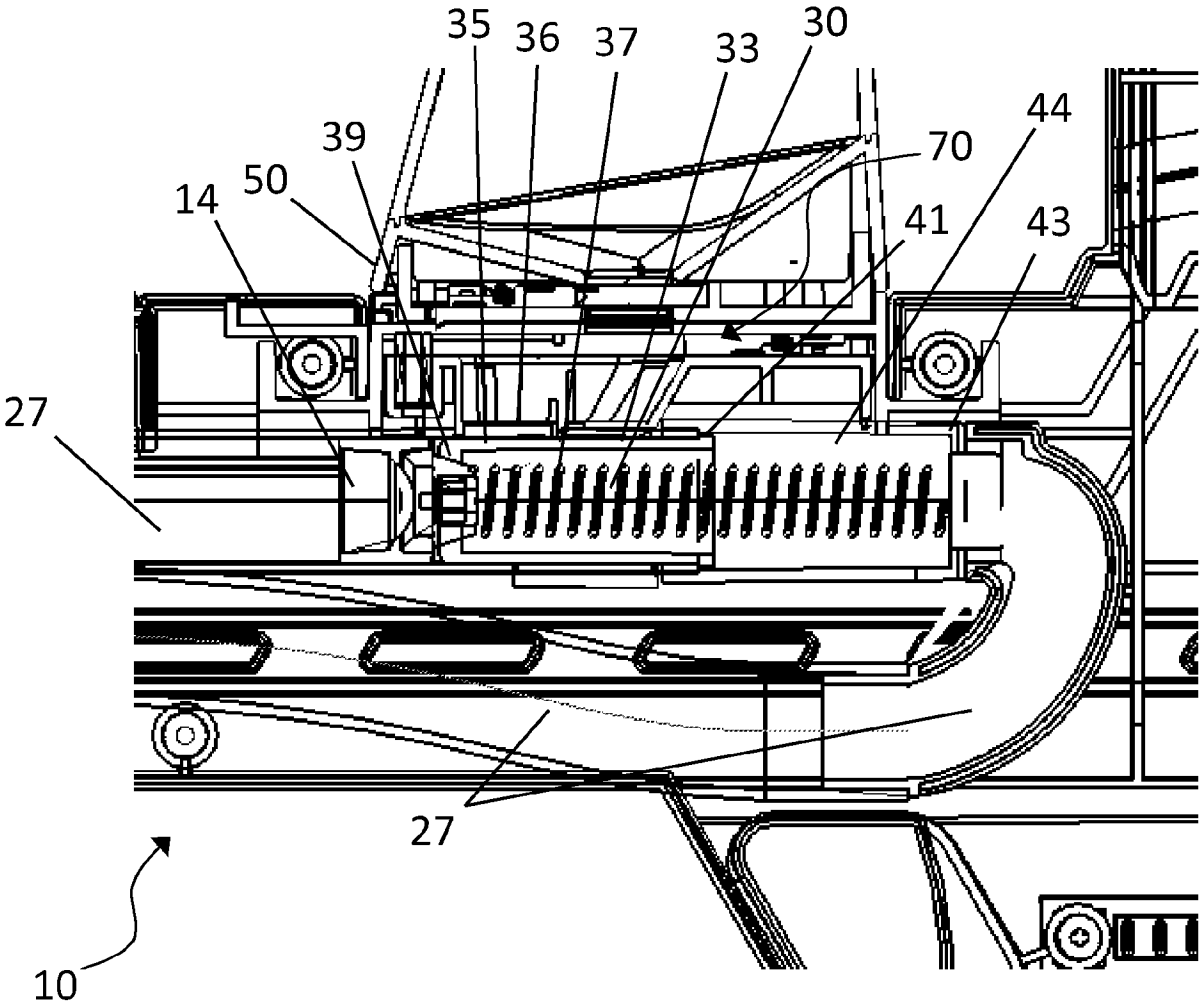
FIG. 6 enlarged cross-sectional view of the portion of the firing mechanism encircled in FIG. 5.

FIG. 6 illustrates an expanded cross-sectional view surrounding the firing position 30 of the projection device shown in FIG. 4. The projection device 10 of the embodiment shown in FIG. 6 includes a magazine 50 that holds soft projectiles, such as ammunition formed from a SAP. The projection device 10 may include a loading mechanism 33 to ensure only a single soft projectile at a time is loaded from the magazine 50. Numerous types of loading mechanisms may be used without departing from the scope of the present patent document. The loading mechanism 33 of the embodiment of FIG. 6 is explained below as an example of one type of loading mechanism that may be used.

The barrel portion 15 of the smaller diameter tube 27 has an opening 36 which provides access to the interior of the smaller diameter tube 27 directly above the firing position 30. The opening 36 is large enough for a single soft projectile to fit through. The opening 36 allows the soft projectile to pass from the magazine 50 into the firing position 30 of the projection device 10.

However, without the loading mechanism 33, there would be no control over when the soft projectiles where allowed to descend into the firing position or how many soft projectiles descended into the firing position. Furthermore, without a loading mechanism 33, soft projectiles would be able to drop into the firing position 30 behind the soft projectile holder 14, which would potentially prevent the projection device 10 from working. The loading mechanism 33 controls the loading of soft-projectiles into the firing position and prevents unwanted loading by selectively obstructing the opening 36 in the barrel portion of the smaller diameter tube 27 directly above the firing position 30.

The loading mechanism 33 shown in the embodiment of FIG. 6 comprises a plunger 35, a spring 37, and a plunger chamber 44. The plunger 35 is a hollow cylinder that has an outer diameter slightly smaller than the inner diameter of the barrel 15. The plunger chamber 44 is a portion of the smaller diameter tube 27 or barrel 15 just behind the firing position 30. The plunger 35 is designed to telescope in and out of the plunger chamber 44. The plunger is biased in its fully extended position by spring 37 and retained by an interference with the plunger chamber 44.

The plunger 35 is positioned in the barrel 15 under the opening 36 and the magazine 50. The plunger 35, which is cylindrical in the present embodiment, includes a first flange 39 on the interior of its forward end and a second flange 41 on the exterior of its back end. A compression spring 37 is mounted inside the plunger 35 so that a first end abuts the first flange 39 and the second end extends back into a plunger chamber 44. The second end of the compression spring abuts a third flange inside the plunger chamber 44.

In a preferred embodiment, the plunger 35 has a cylindrical design and the first, second, and third flanges have a small annular height in order to maintain the smaller diameter tube 27 and the barrel 15 substantially open to air flow.

When the user pulls the handle 11 of the projection device back in preparation for firing, a vacuum is pulled on the smaller diameter tube 27 causing the soft-projectile holder 14 to be drawn towards the back of the gun as explained above. As the soft-projectile holder 14 is pulled back by the vacuum, the soft-projectile holder 14 begins to push on the plunger 35 of the loading mechanism 33. In turn, the plunger 35 telescopes back into the plunger chamber 44, compresses the spring 37, and allows the soft-projectile holder 14 to continue to be drawn backwards by the vacuum in the smaller diameter tube 27.

In the preferred embodiment, the fully retracted position of the plunger 35 into the plunger chamber 44 is designed to be the fully compressed position of the spring 37. In another embodiment, the plunger may interfere with a second portion of the plunger chamber 44 to restrict the retraction of the plunger 35 into the plunger chamber 44 to be where the soft-projectile holder 14 is positioned just slightly behind the opening 36 in the top of the barrel 15 (i.e., when the soft-projectile holder 14 is just behind the firing position 30). Once the soft-projectile holder 14 is retracted to just behind the firing position 30, the plunger 35 and/or soft-projectile holder 14 are/is no longer obstructing the opening 36 above the firing position 30 in the barrel 15 and a single soft-projectile may drop into the firing position 30 of the barrel 15.

Preferably, the spring 37 maintains a constant bias on the plunger 35 in order to maintain the plunger in its fully extended position blocking the opening 36. Once a vacuum is no longer being pulled on the smaller diameter tube 27 or the firing mechanism 33 has been released, the spring 37 forces the plunger 35 forward back into its steady state position blocking any additional soft-projectiles from entering the barrel 15.

Preferably, the spring 37 has a sufficiently small spring constant to allow it to be retracted with the force generated from soft-projectile holder 14 as it is pulled back down the barrel 15 by the vacuum created when the user retracts the handle 11. The spring constant should also be sufficiently small so that the spring does not cause the plunger 35 to force the soft-projectile holder 14 down the barrel 15 prematurely should a vacuum no longer pull the soft-projectile holder 14 backward. For example, if the user where to retract the handle 11 of the gun and then hold it for a period of time prior to releasing it, small leaks in the system may prevent the plunger 35 from continually being retracted in the plunger chamber 44.

Preferably the compression spring 37 is also designed to bias the plunger 35 to maintain the plunger's position obstructing the opening above the firing position in the barrel 15 when a soft-projectile is not being loaded. The plunger 35 is retained in the obstructing position by the second flange 41 on the back of the plunger 35 which interferes with a flange on the inside of plunger chamber 44.

Although the embodiment of FIGS. 4-6 illustrates a device 10 having a firing mechanism designed to use a combination of spring and air pressure projection device 10 may use any suitable type of firing mechanism. For example, the firing mechanism may rely exclusively on spring or air pressure. Alternatively, the firing mechanism may be a catapult type system, sling shot type system, bow style system or any other type of suitable acceleration system to launch the soft-projectile 16. As another example, projection device 10 may accelerate the soft-projectile 16 or soft-projectile holder 14 by an accelerating mass, like the hammer of a gun, directly impacting the soft-projectile or soft-projectile holder. Furthermore, the embodiment of FIGS. 4-6 may all be set up to work with stored energy or work with only energy provided by a user without departing from the scope of the present patent document.

In the soft-projectile 16, either through pneumatic force or mechanical impact, it is preferable to modify the durability of the soft-projectile to allow the soft-projectile to withstand the direct force of the firing mechanism. To this end, the properties of the soft-projectile may be modified to further adapt it to work with a direct force firing mechanism. For example and as explained above, the gel hardness of SAPs may be modified by changing their cross-link density. Thus, the projectiles 16 made from a SAP may be made harder to work with a direct force firing mechanism by increasing their cross-link density.

FIGS. 7A-7D shows various views of a magazine 50. The magazine 50 embodied in FIGS. 7A-7D includes a locking mechanism 60 to prevent access to the interior of the magazine 50 except when the magazine 50 is mated to a projection device 10 or some other mating device designed to allow such access. For example, one such additional device may be a container designed to refill the magazine with additional hydrated rounds of SAP ammunition.

Figure 7A:
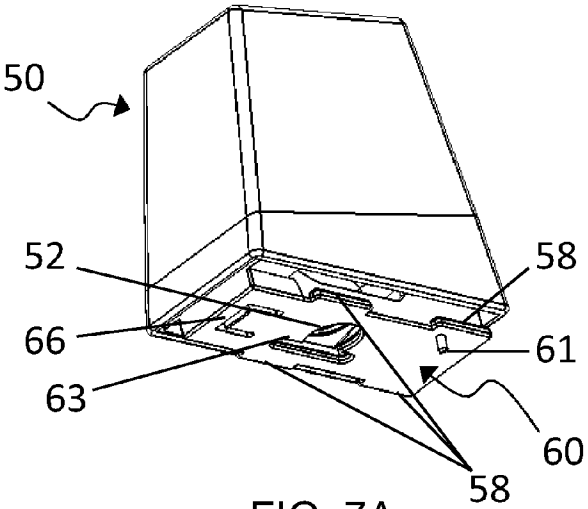
FIG. 7A illustrates a perspective view of a magazine for use with a projectile launching device.
Figure 7D:
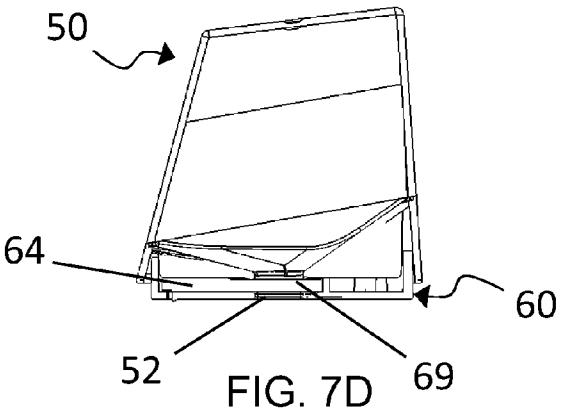
FIG. 7D illustrates a cross-sectional side view of the magazine of FIG. 7A.
Figure 7B:
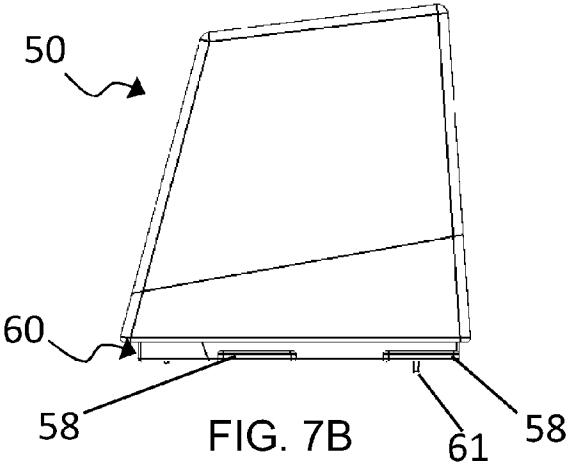
FIG. 7B illustrates a side view of the magazine of FIG. 7A.
Figure 7C:
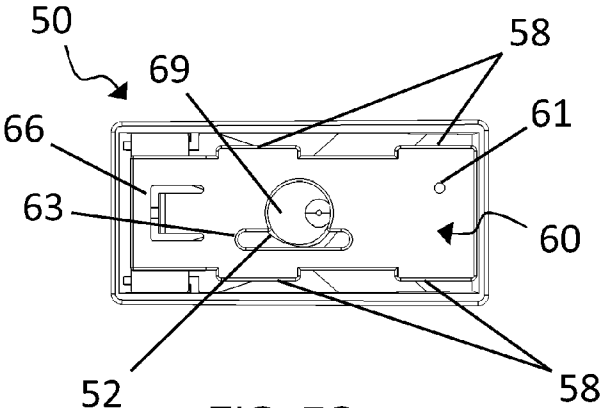
FIG. 7C illustrates a bottom view of the magazine of FIG. 7A.

FIG. 7A illustrates a perspective view of a magazine 50. FIG. 7B illustrates a side view of the magazine of FIG. 7A. FIG. 7C illustrates a bottom view of the magazine of FIG. 7A. FIG. 7D illustrates a cross-sectional side view of the magazine of FIG. 7A.

In order to minimize the risk that objects other than the desired ammunition, such as soft-projectiles 16 made from a SAP are used with projection device 10, complementary locking mechanisms 60 and 70 may be used as part of both the magazine 50 and the projection device 10, respectively. The complementary locking mechanisms 60 and 70 are designed to prevent access to the interior of the magazine 50 and projection device 10, respectively, except when the two are mated together, or another device with a corresponding locking mechanism. The locking mechanism 60 prevents loading of foreign objects into the magazine 50 and locking mechanism 70 prevents foreign objects from being directly loaded into the firing chamber of the projection device 10. Numerous types of locking mechanisms may be used for complementary locking mechanisms 60 and 70 without departing from the scope of the present patent document. The complementary locking mechanisms 60 and 70 of magazine 50 shown in FIGS. 7A-7D and projection device 10 shown in FIGS. 4-6 are explained below as examples of the types of complementary locking mechanisms that may be used for magazine 50 and projection device 10, respectively.

Figure 8:
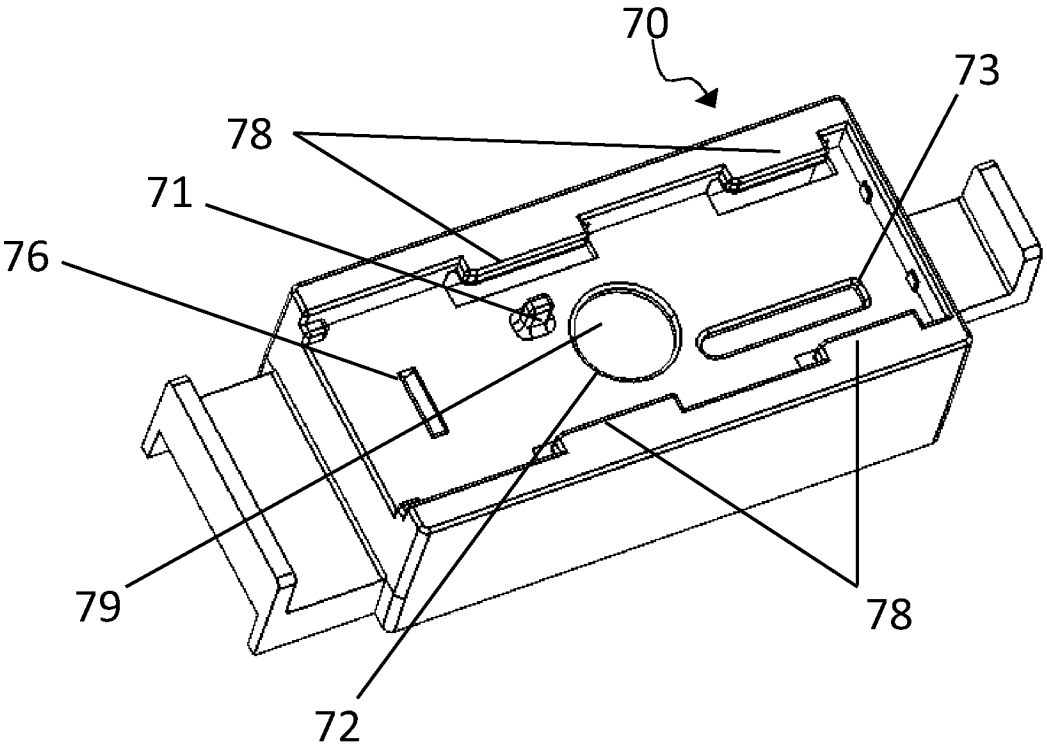
FIG. 8 illustrates a corresponding mating component for the magazine of FIG. 7A.

Before explaining the operation of the complementary locking mechanisms 60 and 70, however, it is noted that FIG. 8 illustrates, in a perspective view, complementary locking mechanism 70 of projection device 10, or potentially another authorized mating device, in isolation. Although FIG. 8 depicts the mating component 70 as a separate component, the features of the complementary locking mechanism 70 in isolation, complementary locking mechanism 70 may be integrated into any device to which it is desired to mate magazine 50, including, for example, projection device 10 or a magazine refill device.

The locking mechanism 60 of magazine 50 shown in FIGS. 7A-7D includes an opening 52. Corresponding locking mechanism 70 includes a corresponding opening 72 meant to mate with the opening 52 of the magazine 50 when magazine 50 is engaged with complementary locking mechanism 70.

Figure 9:
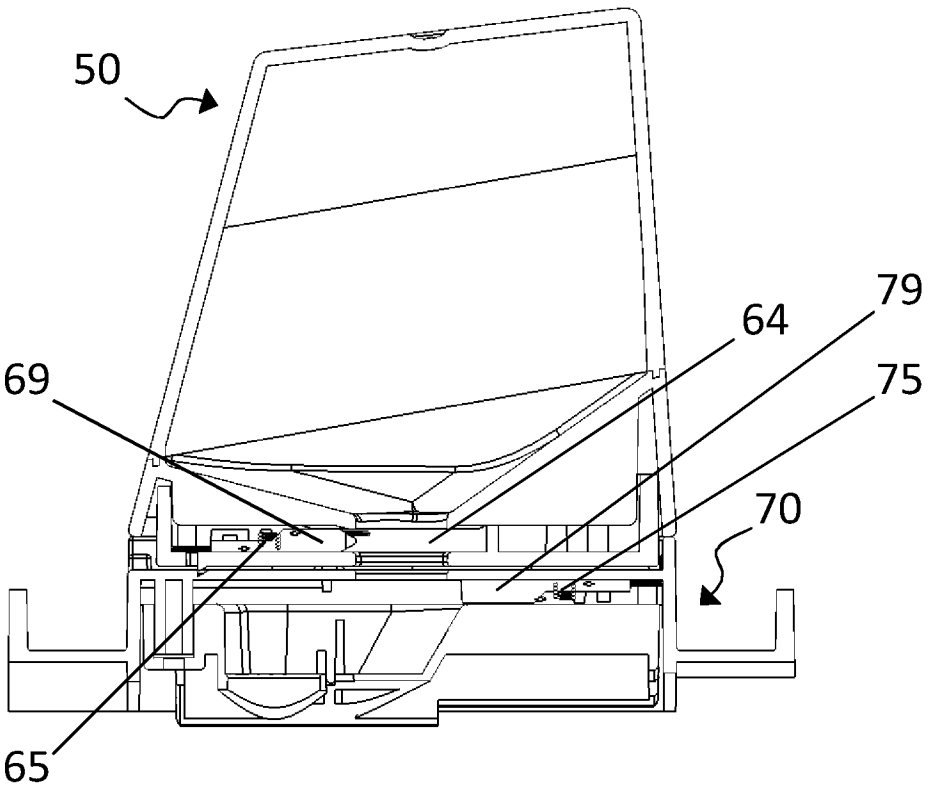
FIG. 9 illustrates a cross-sectional view of a magazine mated to a corresponding locking device.

FIG. 9 illustrates a cross-sectional view of magazine 50 engaged with locking mechanism 70. When the two parts are not engaged, both the opening 52 in the locking mechanism 60 of magazine 50 and the opening 72 in the locking mechanism 70 are obstructed by trap doors 69 and 79, respectively, slideably disposed behind the corresponding openings. For example, the trap door 69 of the magazine 50 is slideably contained within slot 64 of locking mechanism 60 of magazine 50 shown in FIGS. 7D. Likewise, trap door 79 of locking mechanism 70 is slideably disposed behind opening 72 of locking mechanism 70 of projection device 10. Preferably the trap doors 69 and 79 are biased by springs 65 and 75 to force them over their respective openings when the magazine 50 and projection device 10 are not engaged.

When the magazine 50 is correctly mated with the corresponding locking mechanism 70 of projection device 10 or other desired device, the trap doors 69 and 79 are both retracted against the biasing force of springs 65 and 75 so that they no longer block their respective openings 52 and 72, and soft-projectiles may thus pass between the magazine 50 and projection device 10 or other corresponding device.

In the embodiment shown in the figures, the magazine 50 is initially mated to the corresponding locking mechanism 70 forward of its final position and is then slid back into its final position where a small tongue spring 66 snaps into a groove 76 provided on the corresponding locking mechanism 70. The tongue spring 66 prevents the magazine 50 from accidently sliding forward and becoming disengaged from the corresponding locking mechanism 70 of projection device 10 or other mating device, during use. However, when the user desires to reload the magazine with additional super absorbent polymer projectiles 16, the user may reverse the process by sliding the magazine forward so that it may removed from corresponding locking mechanism 70 of projection device 10.

The tabs 58 located on the bottom of the magazine 50 correspond to a set of flanges 78 provided on corresponding locking mechanism 70 such that the magazine 50 must be initially engaged forward of its final position and then slid back into place. Once the magazine 50 is slid back into place on the corresponding locking mechanism 70, the tabs 58 are disposed under the corresponding flanges 78. The tabs 58 and the flanges 78 thus cooperate to further secure the magazine 50 to the corresponding locking mechanism 70.

As may be seen from FIGS. 7A-7C, magazine 50 includes a key 61. As shown in FIG. 8, the corresponding locking mechanism 70 also includes a key 71. Furthermore, both the locking mechanism 60 of magazine 50 and the corresponding locking mechanism 70 have a mating slot 63 and 73 for the keys 61 and 71, respectively. When the locking mechanisms 60, 70 are initially mated, each of the keys 61 and 71 extends through corresponding slot 63 and 73, respectively, on the other locking mechanism. More particularly, the key 61 located on the locking mechanism 60 of magazine 50 extends through the slot 73 at one end of the slot 73, and the key 71 located on the corresponding locking mechanism 70 extends through the slot 63 on the locking mechanism 60 of the magazine 50 at one end of the slot 63. Each of the keys 61, 71 extends through the corresponding slot 63, 73 and engages a key receiver in trap doors 69, 79, respectively. Each of the key receivers in trap doors 69, 79 is specifically designed to mate with the corresponding key 61, 71. Accordingly, when the magazine 50 is slid back into its final mating position on the corresponding locking mechanism 70, the key 61 on the locking mechanism 60 of the magazine 50 pulls open the trap door 79 on the corresponding locking mechanism 70. Similarly, the key 71 located on the corresponding locking mechanism 70 pulls open the trap door 69 on locking mechanism 60 of the magazine 50. Thus once the complementary locking mechanisms 60, 70 are mated, both trap doors 69, 79 are pulled back against the bias of their respective springs and the openings 52 and 72 are aligned and projectiles 16 may pass between without interference by the trap doors 69, 79.

Although as illustrated in FIGS. 7A-7D and 8 and discussed above the keys 61, 71 are shaped as a simple post and trap doors 69, 79 contain a key receiver in the shape of a hole, more complicated key and key receiver combinations are possible. For example, similar to the sophisticated notches on a car key or house key, keys 61 and 71 may contain a more sophisticated design to further ensure that the trap doors 69, 79 are not opened without the parts being engaged to an authorized mating component. Similarly, the mating key receiver for keys 61 and 71 may include the required sophistication to ensure they may operatively mate with keys 61, 71, respectively. Furthermore, more than one key may be incorporated into each part such that a plurality of keys must mate in order to release the trap door 69 or the trap door 79.

In general, any type of keying system may be used to ensure that the openings 52 and 72 remain blocked and are only opened when complementary locking mechanisms 60, 70 are mated with an approved corresponding device. As just one example, additional steps may be required such as turning or sliding an additional switch after the complementary locking mechanisms 60, 70 are engaged to open trap doors 69, 79. In yet another embodiment, the opening and closing of the trap doors 69, 79 may be controlled by electronics and a digital key may be exchanged when the locking mechanisms 69,79 are mated to signal to one or more trap door drivers to open the trap door 69, 79 or allow the trap doors 69, 79 to be opened.

In addition to preventing foreign objects from being loaded into the projection device 10 via the magazine 50, in a preferred embodiment, a safety mechanism 100 may also be provided at the end of the barrel 15 to prevent foreign objects, or at least foreign objects larger than a predetermined size, from being loaded down the barrel 15 of the projection device 10. For projection devices formed in the shape of a gun, a safety mechanism 100 at the end of the barrel 15 will minimize the likelihood that a foreign object can be loaded musket style down the barrel 15.

Figure 10:
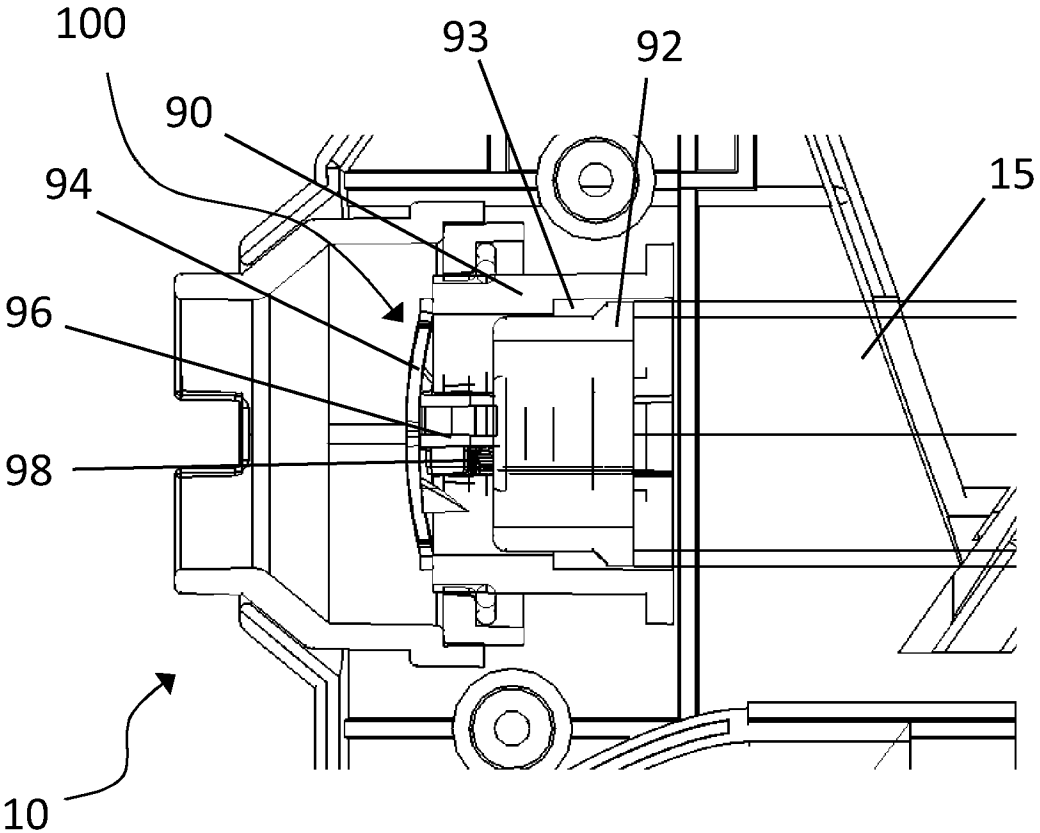
FIG. 10 illustrates an enlarged cross-sectional view of a safety mechanism encircled in FIG. 5 and provided to prevent foreign objects from entering the barrel while still allowing soft projectiles to exit.
Figure 11:
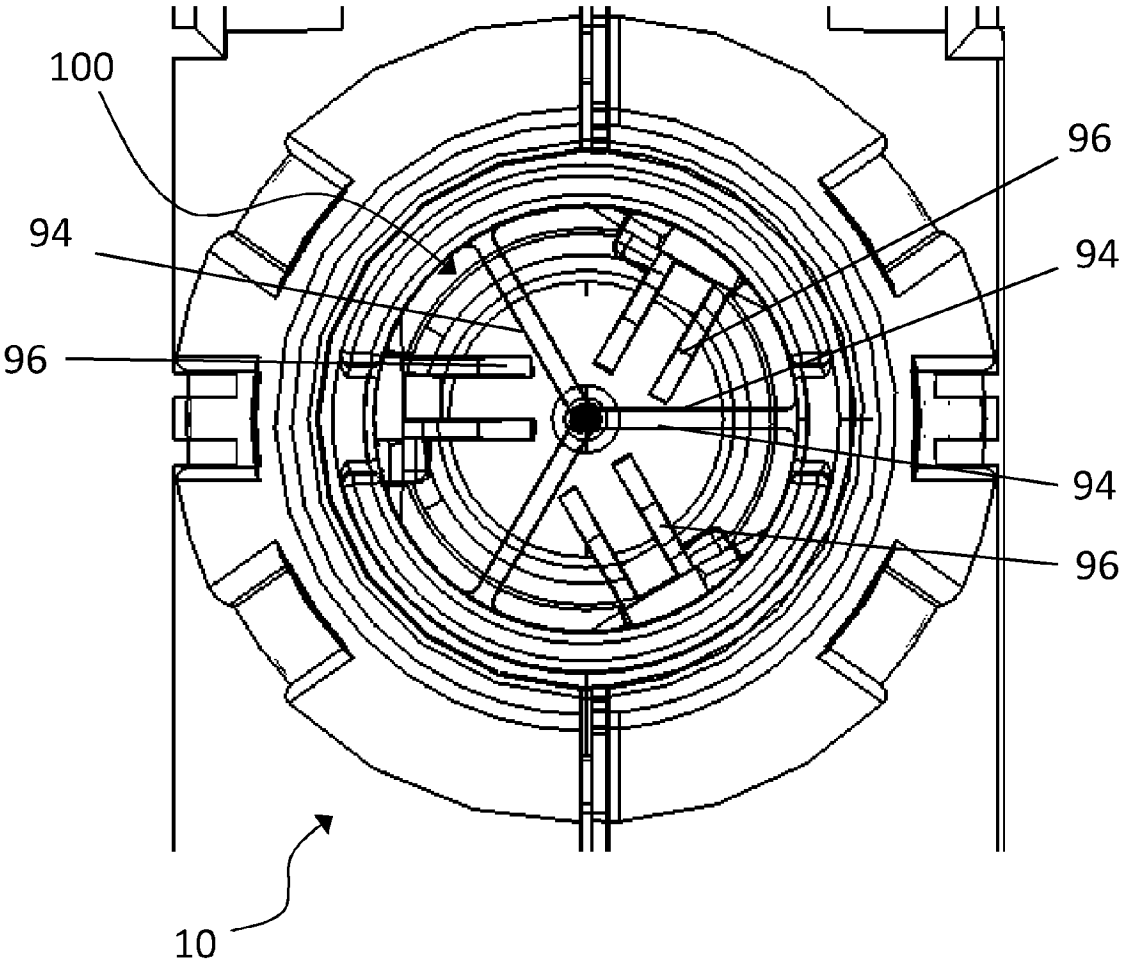
FIG. 11 illustrates a view down the barrel of a projection device including the safety mechanism of FIG. 10.

FIG. 10 illustrates one embodiment of a safety mechanism 100 to prevent foreign objects from entering the barrel 15 while still allowing soft-projectiles 16 to exit barrel 15. However, numerous other types of safety mechanisms may be used without departing from the scope of the present patent document. The safety mechanism 100 of the embodiment of FIGS. 10 and 11 is explained below as an example of one type of safety mechanism that may be used.

Safety mechanism 100 of the illustrated embodiment includes barrel cap 90, stop 92, shields 94, triggers 96, and springs 98.

In the embodiment shown in FIGS. 4-6 and 10, the soft-projectile holder 14 is slideably contained by the barrel 15, but is not otherwise attached to the firing mechanism. At the distal end of the barrel 15, stop 92 retains the soft-projectile holder 14 within a desired operating region of the barrel 15.

In the embodiment of FIG. 10, the stop 92 is slideably contained between the distal end of the barrel 15 and an annular flange of barrel cap 90. The stop 92 is thus allowed to slide axially within the gap 93 provided by barrel cap 90. The stop 92 in the embodiment shown in FIG. 10 is designed as a hollow cylinder. The circumference of the stop 92 is sized to engage with the soft-projectile holder 14 so as to retain the soft-projectile holder within the barrel 15. The inside radius of the stop 92, however, is designed so as to let a soft-projectile 16 pass through. As noted above, barrel cap 90 also includes an annular flange to retain stop 92 in gap 93.

The safety mechanism 100 shown in FIG. 10 also includes shields 94, triggers 96, and springs 98. FIG. 11, illustrates an end view down the barrel 15 of the projection device 10 of FIG. 10 including a safety mechanism 100. As may be seen from FIG. 11, a plurality of shields 94 are designed to cover the opening in the barrel 15 and prevent foreign objects from entering. The embodiment shown in FIGS. 10 and 11, includes 3 pie shaped shields 94 that are spaced evenly at 120 degrees, however, any number of shields 94 may be used to cover the opening in the barrel 15. In addition, the shields 94 may have other sizes or shapes so long as they cooperatively cover the opening in the barrel 15.

In the embodiment shown in FIGS. 10 and 11, shields 94 are connected to triggers 96. Each shield 94 is connected to an individual trigger 96. However, other embodiments may use a single trigger 96 to activate multiple shields 94. Generally, any number of triggers 96 and shields 94 may be used in combination.

Triggers 96 are pivotally connected to the barrel cap 90. Furthermore, each trigger 96 is biased by a spring 98 to the closed position. The shields 94 and triggers 96 are arranged with the springs 98 such that the shields rotate about the outer circumference of the barrel 15 outward and away from the center axis of the barrel 15. In addition, the shields 94 and triggers 96 are operatively arranged with springs 98 such that the shields 94 may not rotate inward back into the barrel 15. Because the shields may not rotate inward towards the center axis of the barrel 15, access to the interior of the barrel 15 is prevented by the shields 94.

The operation of the safety mechanism 100 when the projection device 10 launches a soft-projectile will now be described. As the soft-projectile holder 14 nears the end of the barrel, the soft-projectile holder 14 impacts stop 92. As a result, stop 92 is slides within gap 93 of barrel cap 90 towards the annular flange provided in barrel cap 90. By contrast, in the steady state condition, stop 92 is urged against the end of the barrel 15 by the spring bias of triggers 96.

When the soft-projectile holder 14 impacts the stop 92, the momentum stored in the soft-projectile holder 14 is transferred to the stop 92 and the stop is thus caused to slide forward in gap 93. As stop 92 slides forward in gap 93, the stop 92 engages the triggers 96. Triggers 96 are shaped such that when the stop 92 engages triggers 96 it causes them to rotate outward as stop 92 slides axially within the barrel cap 90. When stop 92 has slid axially to its full extent within gap 93 of barrel cap 90, triggers 96 are caused to rotate enough to rotate the corresponding shields 94 outwardly away from the axis of the barrel 15 and allow a sufficient opening for a soft-projectile 16 to exit unscathed.

Once all the momentum of the soft-projectile holder 14 has been transferred into the stop 92, the biasing force provided by springs 98 forces the triggers 96 to rotate back towards the axes of the barrel and return to their steady state position with the shields 94 covering the opening in the barrel 15. The triggers 96 in turn force the stop 92 to slide back across gap 93 toward the distal end of barrel 15. Stop 92 is held against the distal end of the barrel 15 ready for the next soft-projectile 16 to be launched.

Figure 12:
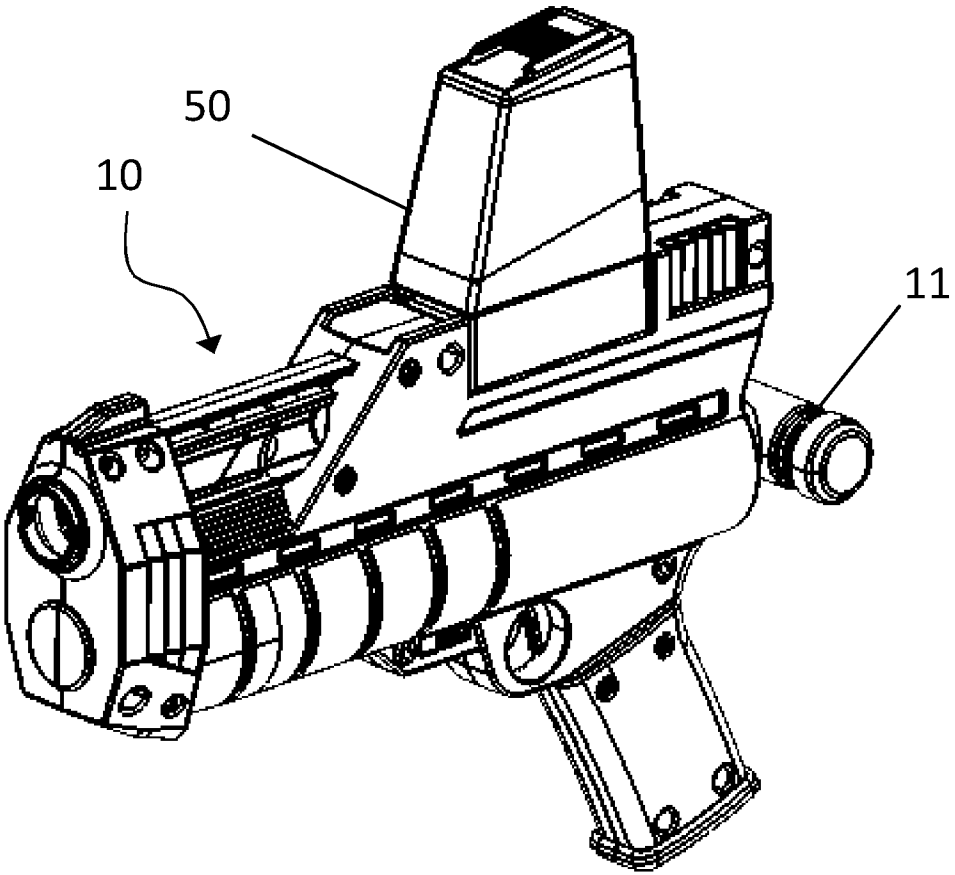
FIG. 12 illustrates a hand gun embodiment of a projection device designed to launch a soft-projectile.

FIG. 12 illustrates a hand gun embodiment of a projection device 10 designed to launch a soft-projectile. Projection device 10 is a smaller hand gun version of the projection device of FIG. 4. The projection device 10 shown in FIG. 12 includes a magazine 50 and a handle 11. The projection device 10 operates internally in a similar manner to the embodiment of FIG. 5.

Figure 13:
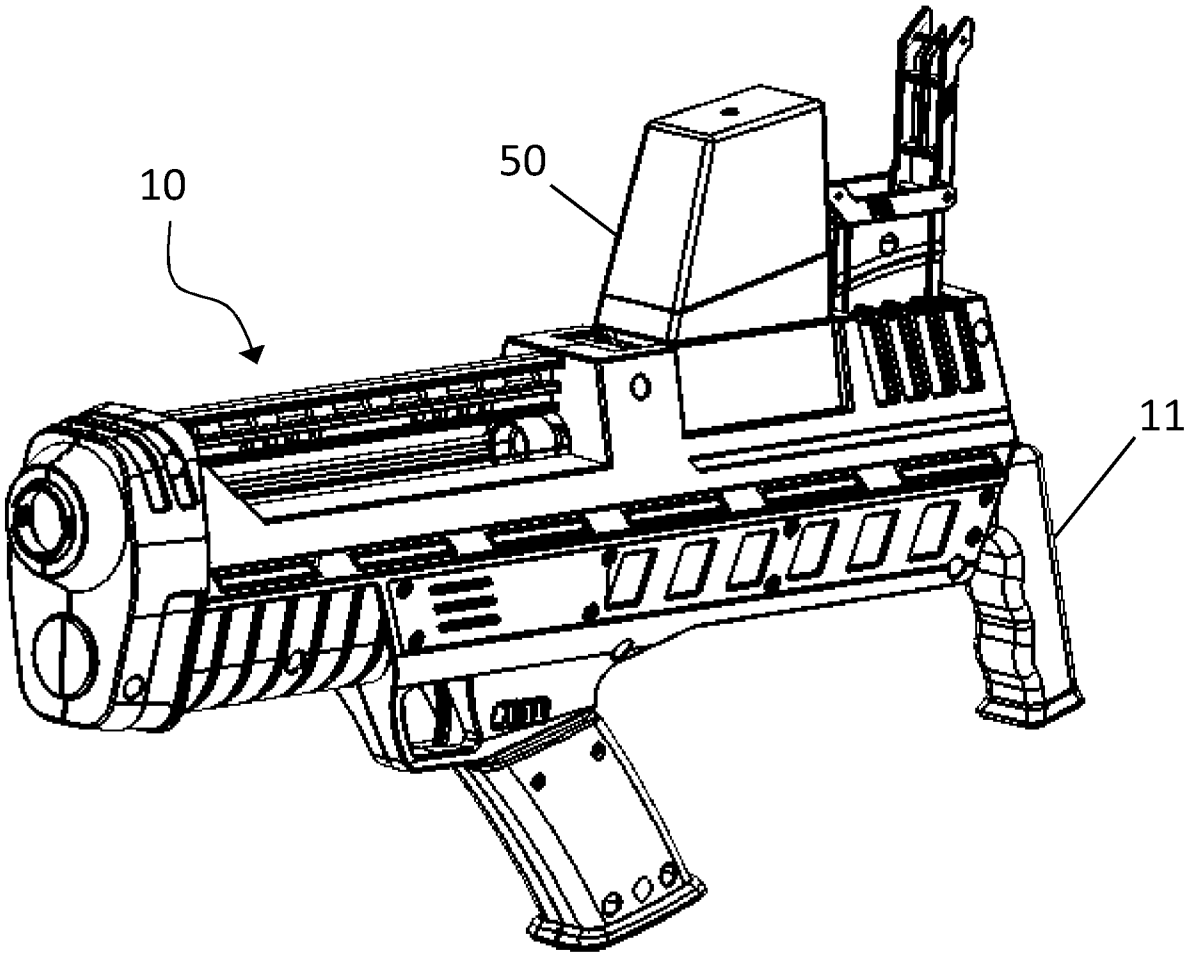
FIG. 13 illustrates another embodiment of a projection device designed to launch a soft-projectile.

FIG. 13 illustrates another embodiment of a projection device 10 designed to launch a soft-projectile. Projection device 10 is a medium sized gun version of the projection device of FIG. 4. The projection device 10 shown in FIG. 13 includes a magazine 50 and a handle 11. The projection device 10 operates internally in a similar manner to the embodiment of FIG. 5.

Although the inventions have been described with reference to preferred embodiments and specific examples, it will readily be appreciated by those skilled in the art that many modifications and adaptations of the methods and devices described herein are possible without departure from the spirit and scope of the inventions as claimed hereinafter. Thus, it is to be clearly understood that this description is made only by way of example and not as a limitation on the scope of the inventions as claimed below.

What is claimed is:

1. A device for projecting a soft-projectile made from a super absorbent polymer, the device comprising:

a feed chamber including a plurality of soft-projectiles having the same shape, each soft-projectile being formed from a hydrated super absorbent polymer, wherein the device is adapted to load a soft-projectile from the feed chamber to a firing position;

a firing mechanism operatively arranged to accelerate the soft-projectile made from a super absorbent polymer, from the firing position, down a barrel; and a safety mechanism obstructing an end of the barrel and designed to prevent access to the interior of the barrel but allow a soft-projectile accelerated by the firing mechanism to exit the barrel.

2. The device for projecting a soft-projectile made from a super absorbent polymer of claim 1, wherein the feed chamber is a removable magazine.

3. The device for projecting a soft-projectile made from a super absorbent polymer of claim 2, further comprising a magazine interface including a locking mechanism between the magazine and the projectile device.

4. The device for projecting a soft-projectile made from a super absorbent polymer of claim 3, wherein the locking mechanism includes at least one key.

5. The device for projecting a soft-projectile made from a super absorbent polymer of claim 3, wherein the locking mechanism includes a slideable door operatively arranged to obstruct an opening designed to receive a soft-projectile.

6. The device for projecting a soft-projectile made from a super absorbent polymer of claim 5, wherein the locking mechanism includes a key receiver.

7. The device for projecting a soft-projectile made from a super absorbent polymer of claim 6, wherein the key receiver is located on a slideable door operatively arranged to obstruct an opening designed to receive a soft-projectile.

8. The device for projecting a soft-projectile made from a super absorbent polymer of claim 1, wherein the soft-projectiles have a diameter of 10 millimeters or less.

9. The device for projecting a soft-projectile made from a super absorbent polymer of claim 1, wherein the device is designed to use air pressure to launch the soft-projectiles.

10. The device for projecting a soft-projectile made from a super absorbent polymer of claim 1, wherein the firing mechanism applies a force directly to the soft-projectile located in the firing position to accelerate the soft-projectile, from the firing position, down the barrel.

11. The device for projecting a soft-projectile made from a super absorbent polymer of claim 1, wherein the device is a toy.

12. The device for projecting a soft-projectile made from a super absorbent polymer of claim 1, wherein the device is in the shape of a gun.

13. A device for projecting a soft-projectile made from a super absorbent polymer, the device comprising:

a feed chamber including a plurality of soft-projectiles having the same shape, each soft-projectile being formed from a hydrated super absorbent polymer, wherein the device is adapted to load a soft-projectile from the feed chamber to a firing position; and a firing mechanism operatively arranged to accelerate the soft-projectile made from a super absorbent polymer, from the firing position, down a barrel.

14. The device of claim 13, further comprising a plurality of shields obstructing an end of the barrel and designed to prevent access to the interior of the barrel but allow a soft-projectile accelerated by the firing mechanism to exit the barrel.

15. The device of claim 13, wherein the feed chamber is a removable magazine.

16. The device of claim 13, wherein the soft-projectiles have a diameter of 10 millimeters or less.

17. The device of claim 13, wherein the device is designed to use air pressure to launch the soft-projectiles.

18. The device of claim 13, wherein the firing mechanism applies a force directly to the soft-projectile located in the firing position to accelerate the soft-projectile, from the firing position, down the barrel.

19. The device of claim 13, wherein the device is a toy.

20. The device of claim 13, wherein the device is in the shape of a gun.

* * * * *